US010513897B1

(12) United States Patent
Swinford

(10) Patent No.: US 10,513,897 B1
(45) Date of Patent: Dec. 24, 2019

(54) SPINNING GAS-SEPARATOR FOR DRILLING FLUID

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 0 days.

(21) Appl. No.: 16/529,106

(22) Filed: Aug. 1, 2019

(51) Int. Cl.
*E21B 21/00* (2006.01)
*E21B 43/34* (2006.01)
*E21B 43/38* (2006.01)

(52) U.S. Cl.
CPC ..... *E21B 21/002* (2013.01); *E21B 43/34* (2013.01); *E21B 43/38* (2013.01)

(58) Field of Classification Search
CPC ..... E21B 21/002; E21B 43/34; E21B 43/38
See application file for complete search history.

(56) References Cited

U.S. PATENT DOCUMENTS 3,995,917 A * 12/1976 Quinlan ..... E21B 10/22 384/95
4,688,650 A * 8/1987 Hayatdavoudi ..... E21B 41/0078 175/324
7,677,308 B2 * 3/2010 Kolle ..... B01D 19/0052 166/105.5
9,157,307 B2 * 10/2015 Schultz ..... E21B 43/34
9,493,999 B1 * 11/2016 Swinford ..... E21B 21/002
10,352,122 B2 7/2019 Swinford

OTHER PUBLICATIONS

Richardson, Ivan "Guide to Nickel Aluminum Bronze for Engineers" (Copper Development Association, Jan. 2016) (Year: 2016).*

* cited by examiner

*Primary Examiner* — George S Gray
(74) *Attorney, Agent, or Firm* — Eric P. Mirabel

(57) ABSTRACT

A gas-separator for separating trapped gases from drilling fluids retrieved from a well-bore being drilled is disclosed. The gas-separator includes a barrel separator which rotates on its longitudinal axis when pressurized drilling fluid flows out through its fluid ejection ports. Ejection of fluids from the fluid ejection ports induces rotation of the barrel separator which helps separate gases from the fluid. After separation, the gases travel out from the upper sub and to the surface, up the well-bore. The treated and gas-cleansed fluid travels downstream to the drill string and any downstream equipment, including pumps, motors, and drill bits, or; treated and gas-cleansed fluid may flow to the surface directly after treatment in the gas-separator.

16 Claims, 9 Drawing Sheets

SPINNING GAS-SEPARATOR FOR DRILLING FLUID

FIELD OF THE INVENTION

This invention relates to gas-separator used for recycling of drilling fluid, and especially, to gas-separators used for separating trapped gases from recyclable drilling fluid.

BACKGROUND

A well-bore is drilled by driving a rotating drilling bit connected to one end of a drill string into the earth. A continuous flow of pressurized drilling fluid (also known as "drilling mud" or "mud") supplied through the drill string is used to lubricate and cool the dill bit and other components of the bottom hole assembly ("BHA"). In some drill pipe drilling operations and in all coil tubing drilling (because coil tubing cannot be rotated on its axis), mud is used to drive a mud motor which powers rotation of the drill bit. The inflowing pressurized drilling fluid gets released at the BHA, near the bottom of the continually-lengthening well bore. The continuous inflow of the pressurized drilling fluid pushes the newly-released drilling fluid up the well bore on the outside of the drill string, and back to the surface of the earth.

On its way back to the surface, the drilling fluid carries away loose dirt, pieces of rock (most of which is generated during cutting action of the drill bit), and gases (including trapped gases which were released while drilling and gases which have seeped into the bore from gaseous zones/formations surrounding the bore).

At the surface, the released drilling fluid is filtered and recycled to make it fit for reuse. Though popular (and commercially viable) filtration and recycling methods remove trapped gaseous impurities to an extent, a considerable amount of gases remain trapped and are passed into the drill string during reuse of the recycled fluid.

These trapped gases may cause cavitation or even 'gas-lock' in the pumping equipment and reduce the hydrostatic pressure within the drill string. Additionally, since the trapped gases may be flammable (such as methane or natural gas), they pose a risk of fire or explosion if not removed. Still further, some trapped gases, including nitrogen and sulfur gas, can react with and corrode the drilling equipment, including especially flexible seals, O-rings and pump components, including impellers.

For separation of gases trapped in continuously flowing pressurized drilling fluid various gas-separators which are installable in the drill string have been proposed. This invention is a substantial improvement over prior art gas-separators.

SUMMARY

The invention is a gas-separator for separating gases trapped in pressurized drilling fluid flowing through a drill string; including a coil tubing drill string. The gas-separator may be attached into the drill string and placed in the well-bore. Several such gas-separators can be used in a series in a drill string during drilling, and some can even be at the surface. The gas-separator is preferably placed upstream of pumping equipment to remove gases, including corrosive gases such as sulfur and nitrogen, from the drilling fluid prior to pump intake. The gas-separator is can also be placed downstream of pumping equipment, or in other locations along the drill string, if the objective is solely to remove gases from drilling fluid (and debris carried with it) which is forced up the well-bore to the surface.

The gas-separator includes a barrel separator which expels pressurized drilling fluid through multiple fluid ejection ports, which access the mud from its central bore, to induce rotation on its longitudinal axis. The fluid ejection ports have a narrower cross-section leading towards bore of the barrel separator and a widening cross-section towards opposite end, to permit gas expansion on exit of pressurized fluid. The axis of the fluid ejection ports is transverse to the axis of the barrel separator and substantially tangential to the outer cross-sectional periphery of the barrel separator. When pressurized fluid (including gases) enters the central bore of the gas-separator (the bore extends through the barrel separator as well), it flows from the central bore through the ejection ports and induces a rotational torque (or spinning force), which spins the barrel separator (which lies between bearings at either end) on its axis. Rotation of the of the barrel separator in turn imparts transverse momentum (sometimes called "centrifugal force") to the drilling fluid in the central bore, which thereby also forces more gas trapped in the drilling fluid outwardly and towards the fluid ejection ports, thereby enhancing the gas separation effect.

Since the gas-separator lies vertically when installed in a drill string, the separated gases travel upstream towards an upper sub (through space between an outer wall of the device and the outside of the barrel separator), and exit through release vents in the upper-sub. The treated drilling fluid exits through a lower-sub and travel downstream, where it can access the BHA directly, or it can access pumps, which pump the treated fluid towards the BHA.

Embodiments of the present invention will be discussed in greater details with reference to the accompanying figures and the detailed description which follows.

Figure 1:
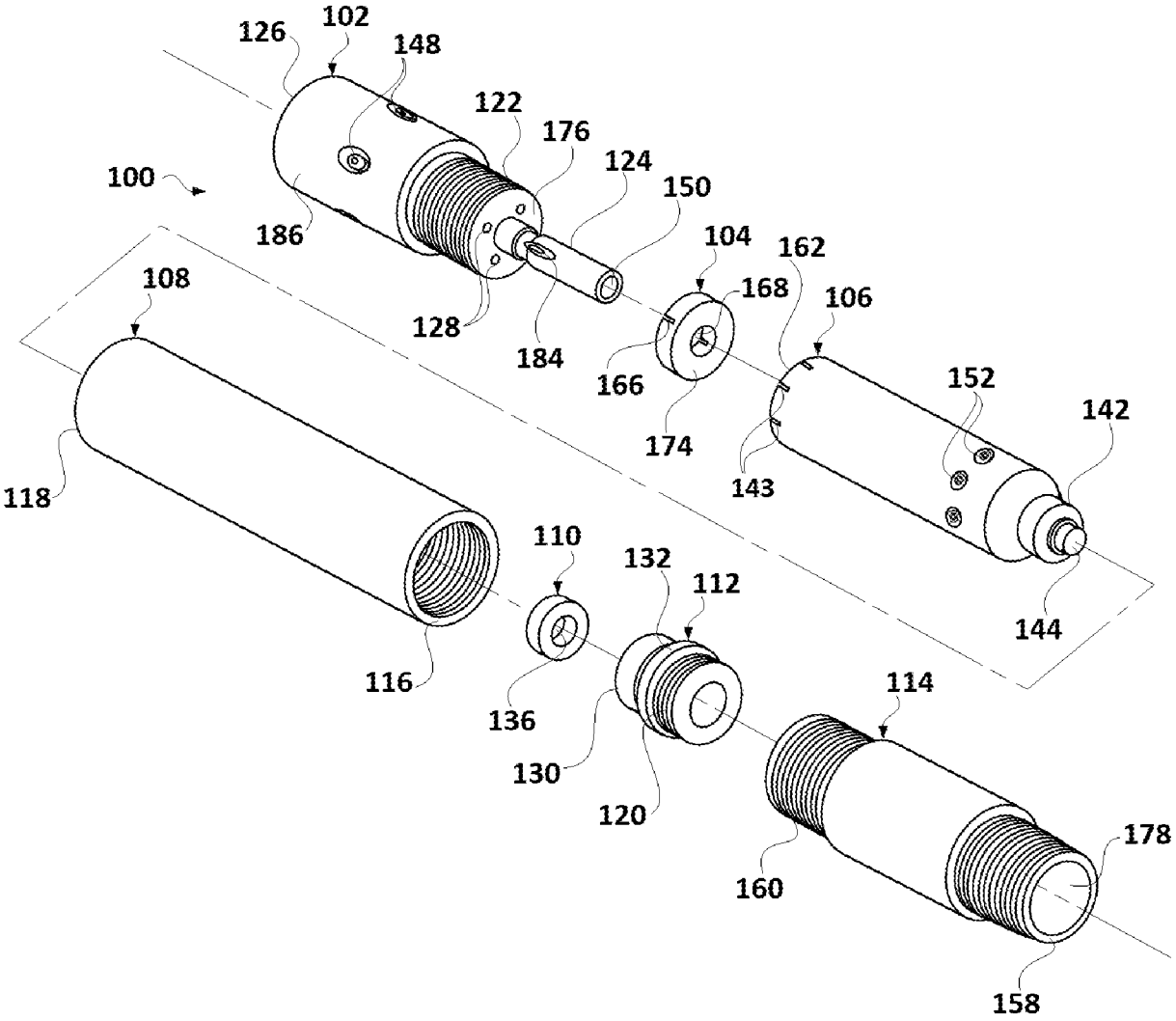
FIG. 1 illustrates an exploded view of parts of a gas-separator in accordance with a first embodiment of the present invention.
Figure 2:
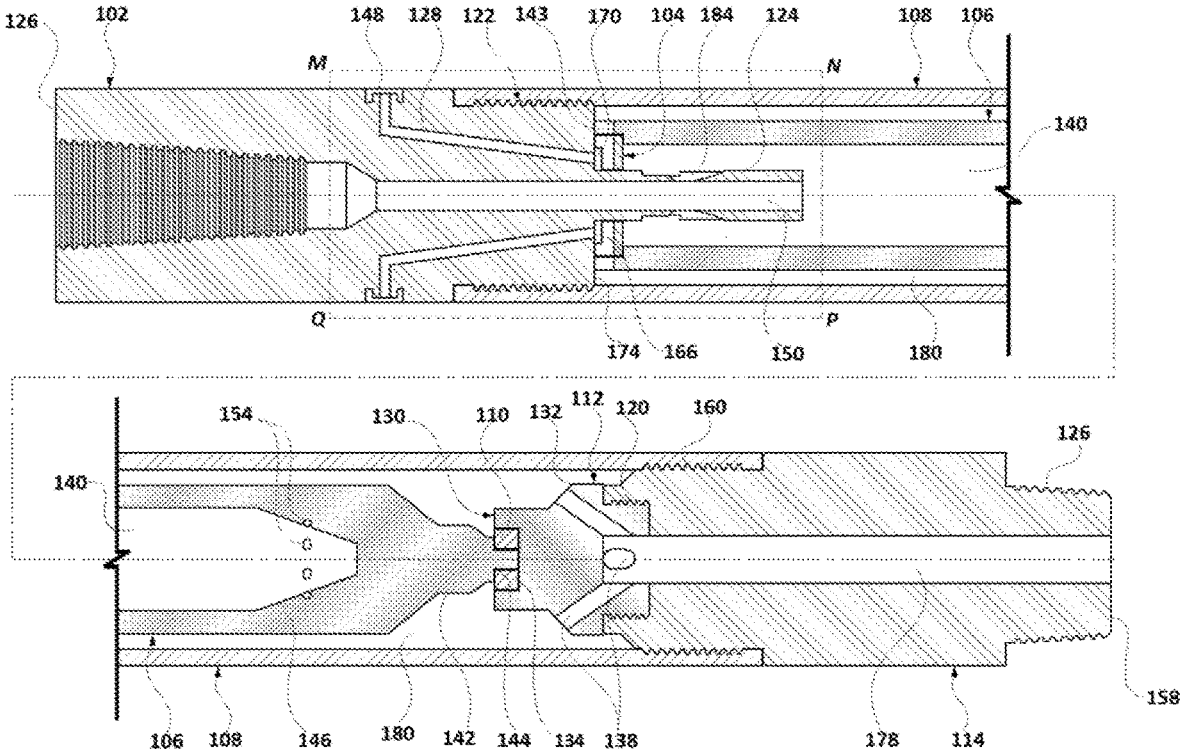
FIG. 2 is a cross-sectional view of the assembled gas-separator in FIG. 1.
Figure 3:
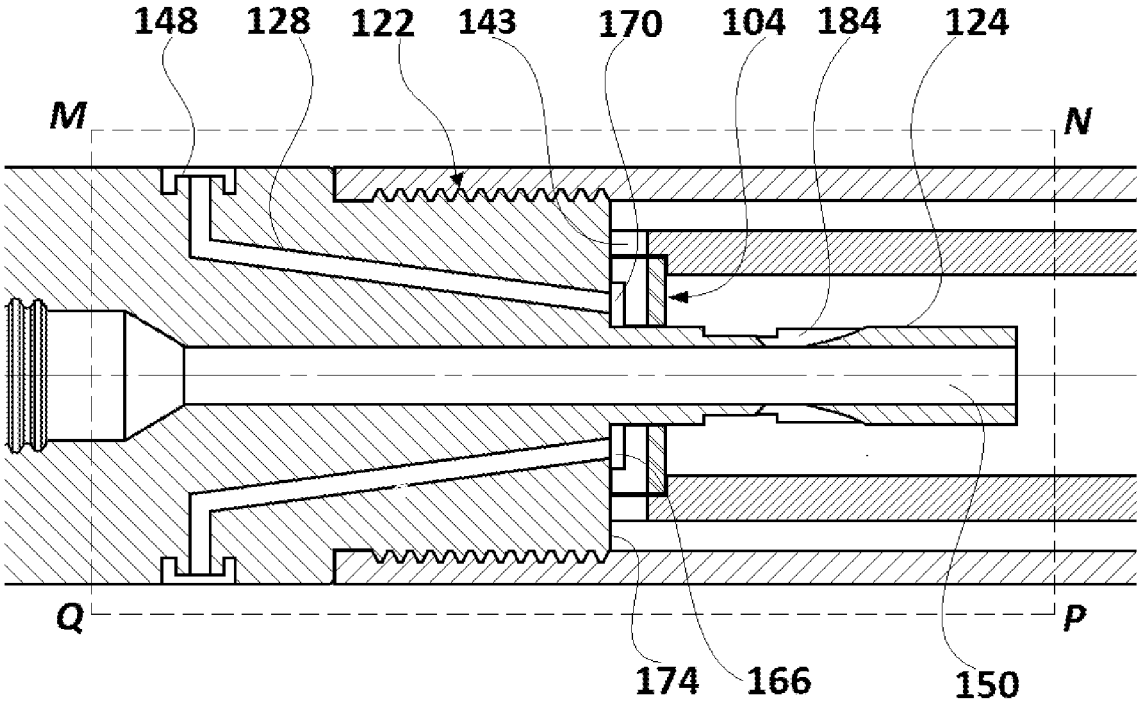
FIG. 3 illustrates an enlarged view of the portion of FIG. 2 bounded by region MNPQ and some of the surrounding features.

It should be understood that the drawings and the associated descriptions below illustrate one or more embodiments of the present invention, but are not to limit the scope of the invention. Also, since the drawings are intended to depict the invention with clarity, they are not necessarily drawn to scale.

DETAILED DESCRIPTION

A first embodiment of a gas-separator of the invention is described below with reference to the figures. As shown in FIGS. 1, 2, 3, 4A-C and 5, the salient parts of gas-separator 100 include an upper sub 102, an upper annular bearing 104, a barrel separator 106, an outer barrel 108, a lower annular bearing 110, a bearing seat 112 and a lower sub 114.

In an operating well-bore, gas-separator 100 connects with the portion of drill string lying above it through upper sub 102, and connects with the portion of drill string lying downstream through lower sub 114. The internally threaded portion proximal to distal end 126 of upper sub 102 and the externally threaded (and tapered) portion proximal to distal end 158 of lower sub 114 screw with respective mating portions of a drill string lying upstream and downstream of the gas-separator 100.

Portions of the inner surface of outer barrel 108 proximal to each of the two ends 116 and 118 (illustrated in FIG. 1) are threaded so as to allow, respectively, externally threaded portion of outer lower side 122 of upper sub 102 and externally threaded portion of outer upper side 160 of lower sub 114 to be screwed into outer barrel 108. Outer upper side 160 further includes an internal threading (seen in FIG. 2) which mates with externally threaded tubular portion 120 of bearing seat 112 in the assembled gas-separator 100.

In addition to threaded tubular portion 120, bearing seat 112 further includes an annular receiver 130 and a channel rim 132. In an assembled gas-separator 100, lower annular bearing 110 fits within cylindrical space 134 of the annular receiver 130. The channel rim 132 includes four delivery passages 138 (illustrated in FIGS. 2 and 7). It is to be noted that the number of delivery passages 138 may be varied based on requirements and preference.

Barrel separator 106 includes central bore 140, support stub 142 and pivot stub 144. The central bore 140 has a constant diameter throughout except at its tapered portion 146 at its lower end.

Tapered portion 146 includes several fluid ejection ports 152 connecting to channels 154 and in turn to central bore 140. In an assembled gas-separator 100, pivot stub 144 mates snugly with central aperture 136 of lower annular bearing 110.

Figure 4A:
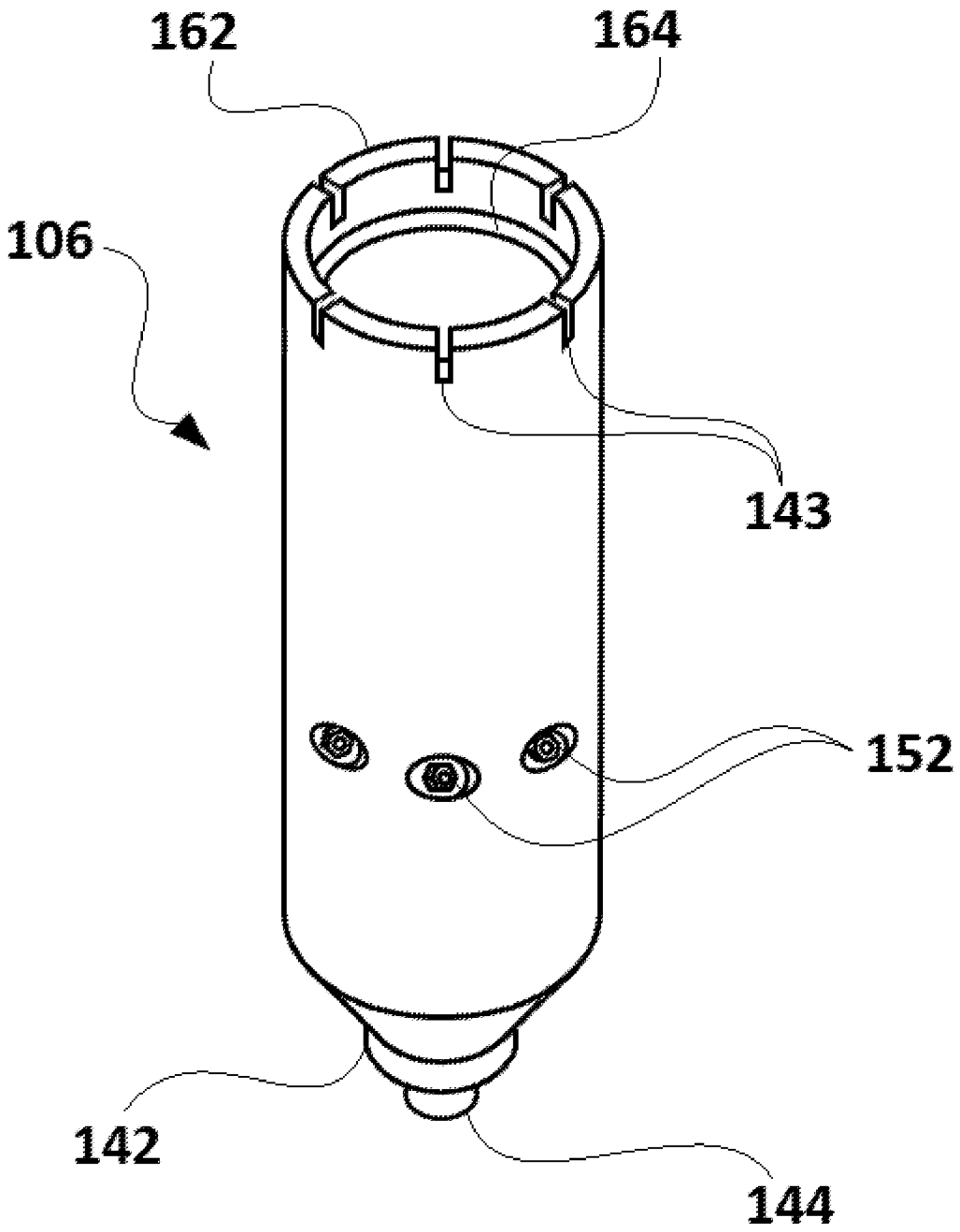
FIG. 4A is a perspective view of the barrel separator of FIGS. 1 and 2 where gas separation takes place.
Figure 4B:
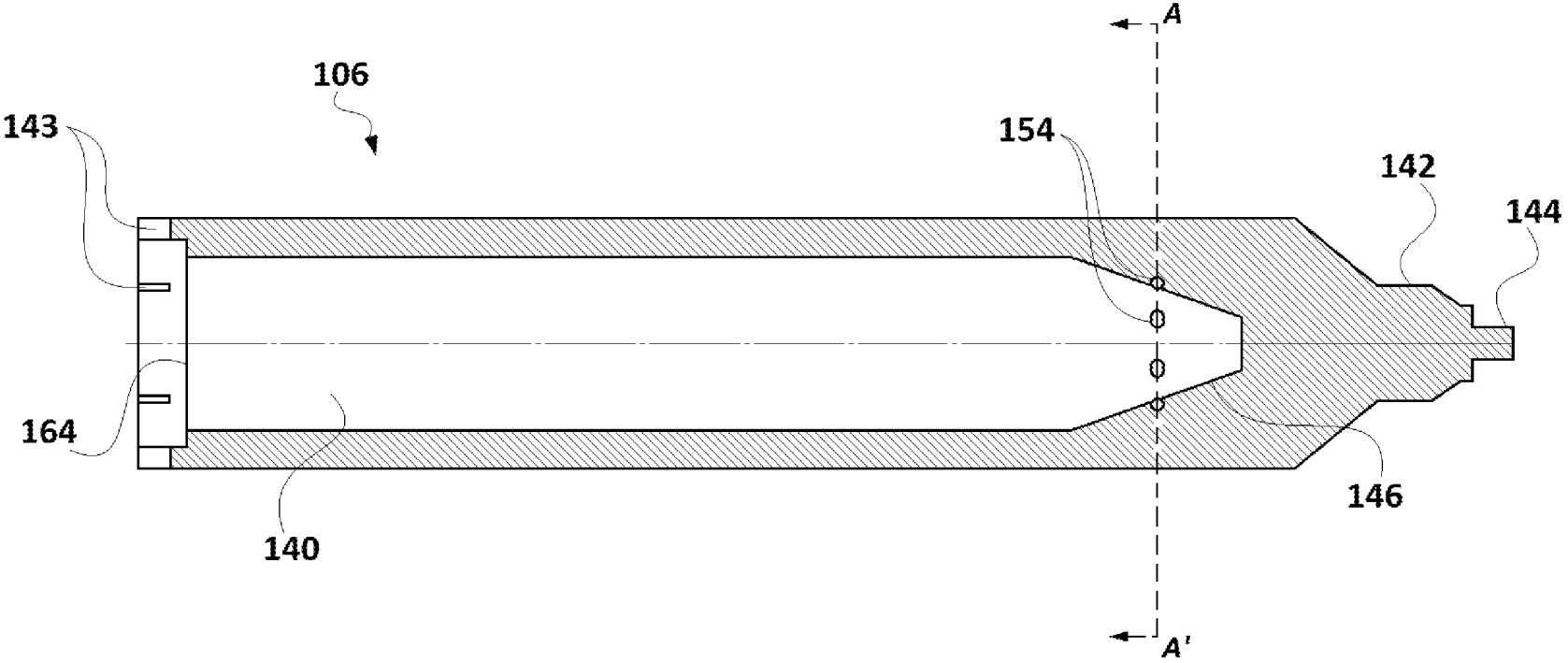
FIG. 4B is a cross-sectional view of the barrel separator in FIG. 4A, taken along its longitudinal axis.
Figure 4C:
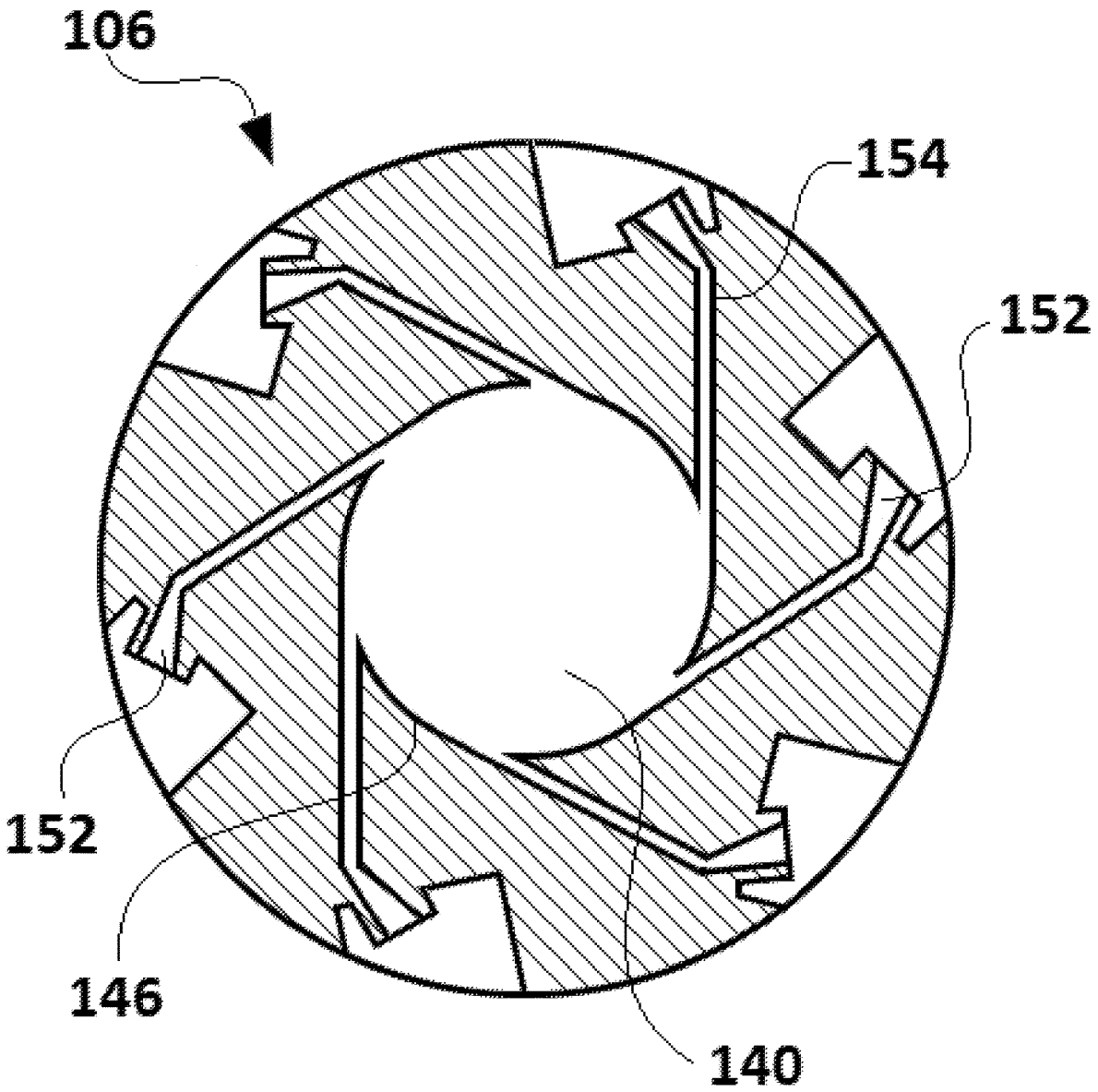
FIG. 4C is a cross-section of the barrel separator in FIG. 4B, taken along the lines A-A'.

As seen in FIG. 4C, channels 154 are narrower cross-section than their corresponding fluid ejection ports 152. Fluid ejection ports 152 have a narrower cross-section towards tapered portion 146 and a widening cross-section towards periphery of barrel separator 106. Further, channels 154 are oriented towards the tangent with respect to the periphery of central bore 140. Fluid ejection ports 152 are oriented at an obtuse angle to channels 154, to expel fluid in a direction which is substantially tangential with the outer surface of barrel separator 106. Other orientations of fluid ejection ports 152 which provide rotational force to barrel separator 106 when fluid and gases are expelled through ports 152 are also within the scope of the invention.

Figure 5:
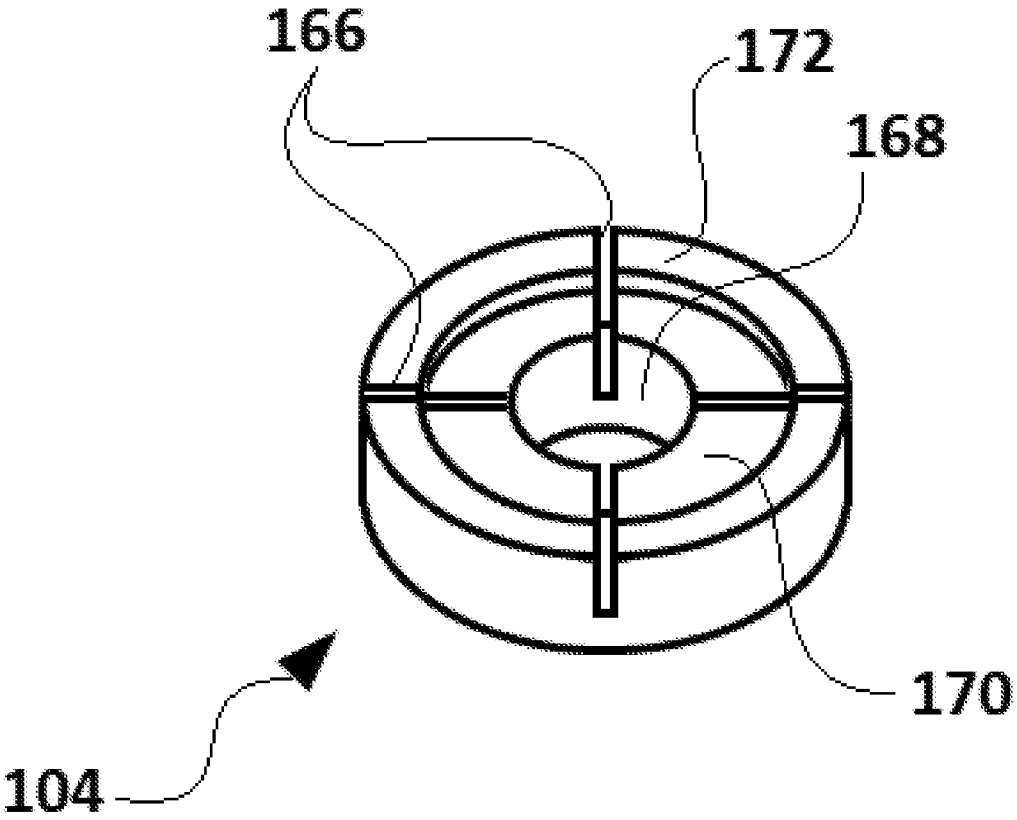
FIG. 5 illustrates a perspective view of a upper annular bearing for use in the first embodiment of the gas-separator of the present invention.

As best illustrated in FIG. 4A, barrel separator 106 includes six annulus notch cuts 143 on the annulus outer wall its upper end 162, and an annulus bearing seat 164. As illustrated in FIG. 5, upper annular bearing 104 includes four notches 166 extending into its upper side from its outer ring to central bore 168, and a fluid space 170. Fluid space 170 is a coaxial cylindrical space below the level of ridge ring 172 of upper annular bearing 104. FIG. 1 shows that the lower face 174 of upper annular bearing 104 is flat, without a ridge. Annulus bearing seat 164 of barrel separator 106 (FIG. 4B) matingly fits over the upper annular bearing 104. The height of upper annular bearing 104 is slightly greater than the depth of annulus bearing seat 164, so a portion of upper annular bearing 104 will extend out of the annulus bearing seat 164.

While the notch cuts 166 extend across the entire outer ring of upper annular bearing 104, their depth is less than the height of upper annular bearing 104. Notch cuts 166 surround fluid space 170. Annulus notch cuts 143 extend through the wall at upper end 162 and their depth (along axis of barrel separator 106) is equal to the depth of notch cuts 166 upper annular bearing. The number of annulus notch cuts 143 and 166 may be varied in other embodiments of the invention.

Upper annular bearing 104 and lower annular bearing 110 are preferably formed of an aluminum-bronze alloy, and more preferably the alloy is 85% Cu, 10.80% Al, 3.67% Fe, 0.42% Mn and 0.11% Ni. These alloys reduce friction between surfaces sufficiently such that roller bearings or bearings with moving components are not necessary.

Upper sub 102 includes an outer wall 186, delivery tube 124, release channels 128 extending from lower surface 176 of the upper sub 102 and connecting with release vents 148 on the outer wall 186, and a central bore 150 (extending the length of upper sub 102). Central bore 150 varies widely in size and shape throughout its length, due to variations in the thickness of the wall of upper sub 102. Central bore 150 is large enough to connect with the central bore 150 threads of the drill string at the upper end of upper sub 102. The outer diameter of delivery tube 124 matches the diameter of central bore 168 of upper annular bearing 104. Delivery tube 124 further includes two delivery ports 184. Bore 150 and ports 184 both permit fluid outflow from upper sub 102. In other embodiments of the invention, the number of delivery ports 184 may be varied.

In an assembled (and vertically installed) gas-separator 100, upper annular bearing 104 matingly fits within the annulus bearing seat 164, and delivery tube 124 extends through central bore 168 and into central bore 140 of barrel separator 106. The lower side of support stub 142 of barrel separator 106 rests on lower annular bearing 110 (pivot stub 144 mates with central aperture 136 of lower annular bearing 110). The lower side of upper annular bearing 104 rests on the lower side of annulus bearing seat 164, whereby barrel separator 106 is rotatable on its axis and rotation friction is reduced by having it contact only upper annular bearing 104 and lower annular bearing 110. Since the height of upper annular bearing 104 is greater than the depth of annulus bearing seat 164, upper end 162 of barrel separator 106 will not contact the lower surface 176 of upper sub 102 (if there was contact, there would be considerable friction on rotation of barrel separator 106).

Still further, in an assembled gas-separator 100, each release channels 128 (along with its connected release vent 148) connects fluid space 170 with the exterior of the gas-separator 100. Similarly, passages 138 connect central bore 178 of lower sub 114 with the central bore 180 of outer barrel 108. Additionally, channels 154 and the connected fluid ejection ports 152 connect the central bore 140 with central bore 180 of outer barrel 108.

Figure 6:
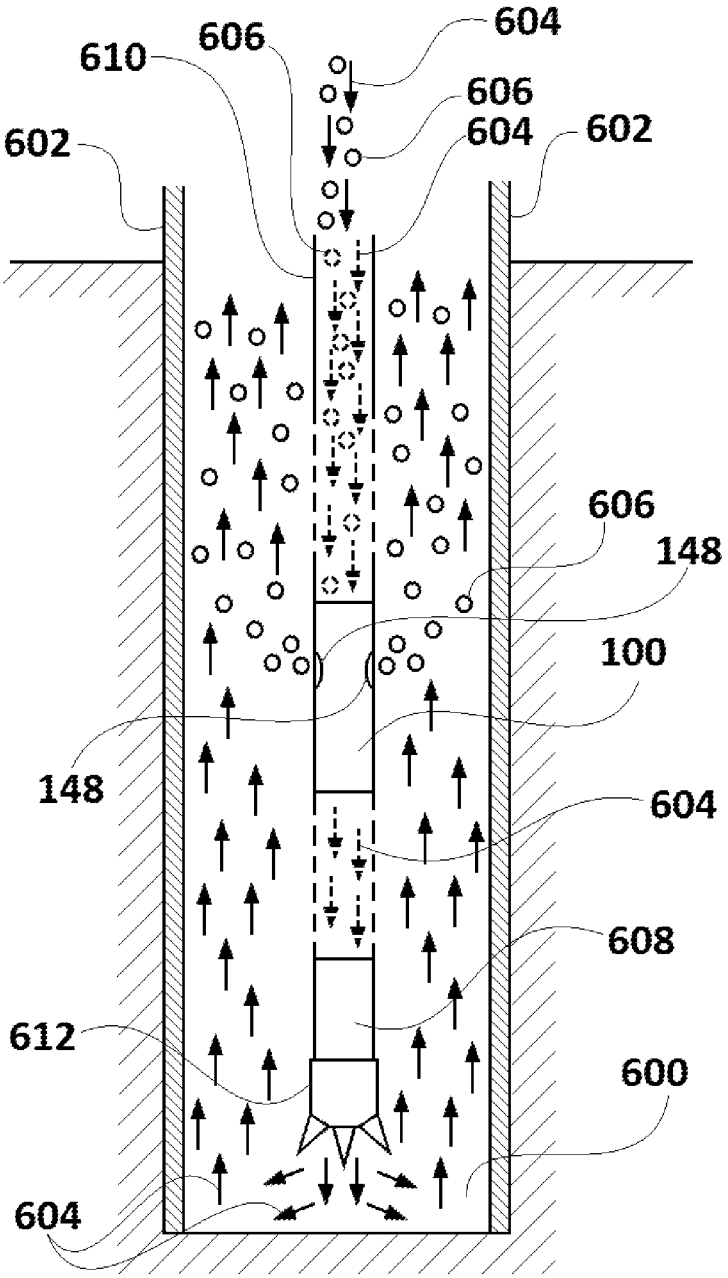
FIG. 6 illustrates positioning of the gas-separator installed in a drill string of a well-bore.

Operation of gas-separator 100 in a drill string of well-bore for separating gases from drilling fluid will now be explained with reference to FIGS. 6 and 7. FIG. 6 illustrates positioning of the gas-separator 100 and an overall process of gas-separation within a well-bore 600 (having a casing 602). In FIG. 6, while the drilling fluid and its direction of flow is depicted by arrows 604, the trapped gases in the drilling fluid are depicted as bubbles 606. As illustrated in FIG. 6, in the well-bore 600, the gas-separator 100 is placed upstream of the PDM motors and pumps (together depicted as 608) in a drill string 610. Removal of the trapped gases, especially nitrogen and sulfur, from the drilling fluid protects the motors and pumps 608 (especially the rubber and rubber-like components including seals and O-rings of these motors and pumps 608), and also cleanses the drilling fluid forced up the well-bore to the surface. The motors and pumps 608 receive treated drilling fluid 604 from the gas-separator 100, and pass on compressed/pressurized treated drilling fluid to the BHA and to drilling bits 612 positioned below or downstream.

After driving the drilling bits 612 with compressed treated drilling fluid 604, the drilling fluid 604 is pushed upwards towards the surface through well-bore 600. Drilling fluid 604 carries fragmentary material (loose soil, rock chips) and fluids in the well-bore (such as gases 606 and water) to the surface. On reaching the surface, retrieved drilling fluid 604 (including fragmentary materials, gases and liquids), which has already had gases separated out, is collected at recycling units for removal of non-gaseous foreign material. From there it can be re-used.

Figure 7:
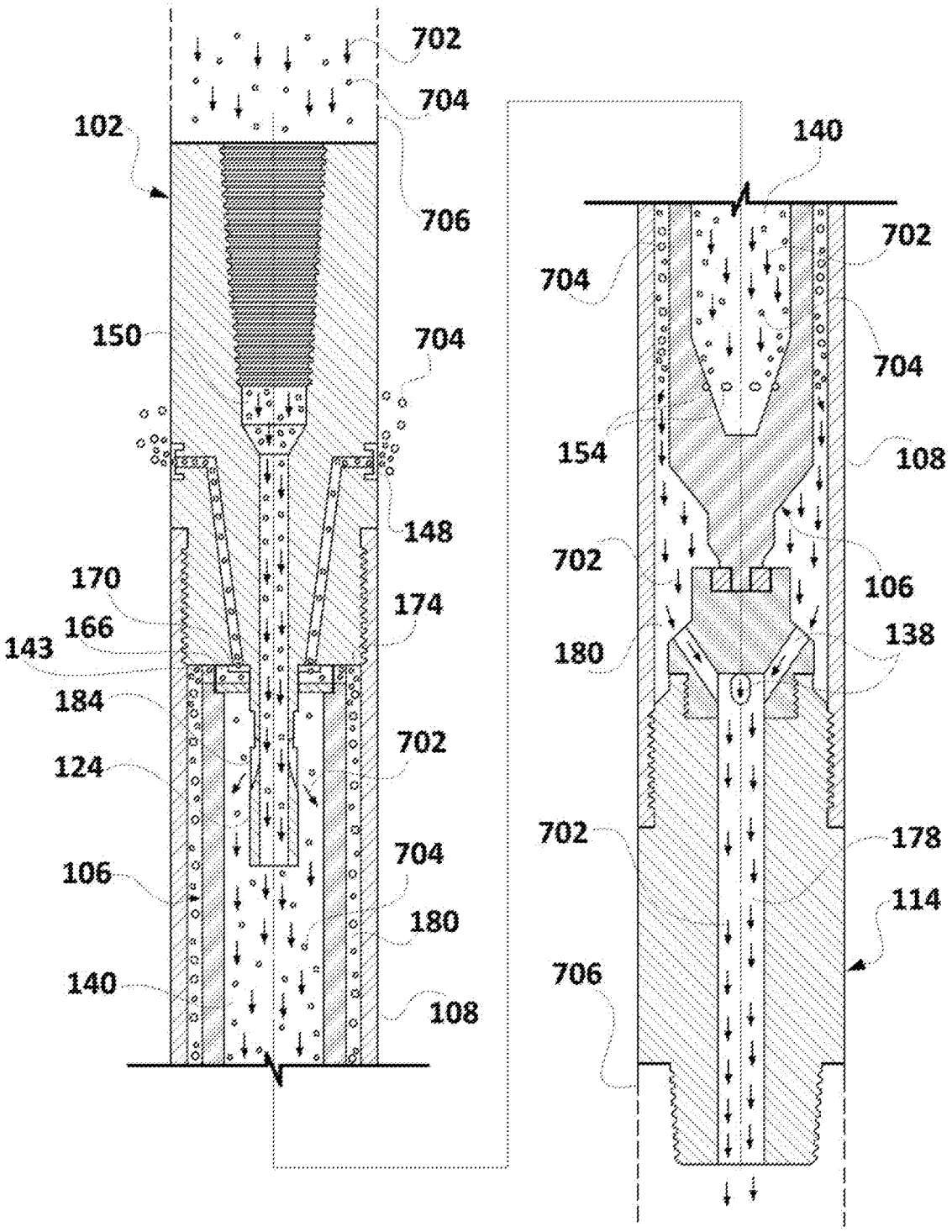
FIG. 7 is a cross-sectional view of the first embodiment of the gas-separator illustrating gas separation therein.

FIG. 7 illustrates the gas separation process within gas-separator 100. Gas-separation from drilling fluid 702 (having trapped gases 704) starts with pumping drilling fluid 702 into gas-separator 100, from drill string 706. It first enters central bore 150 of upper sub 102, then is central bore 150 delivered into central bore 140 through delivery tube 124 and delivery ports 184. Drilling fluid 702 (and trapped gases 704) within bore 140 are forced into channels 154 and ultimately ejected from fluid ejection ports 152 (not illustrated in FIG. 7). Since the fluid ejection ports 152 have a narrower cross-section towards tapered portion 146 and a widening cross-section towards periphery of barrel separator 106, exit of pressurized fluid 702 through them causes expansion of trapped gas. This results in separation of trapped gases 704. Further, due to the alignment and configuration of channels 154 and their connected fluid ejection ports 152, as described above, while exiting the fluid ejection ports 152, the drilling fluid 702 (and trapped gases 704) provide a rotational torque (or spinning force) to the barrel separator 106. Spinning of barrel separator 106 forces the drilling fluid within central bore 140 to move towards ports 152, thereby further increasing the gas separation effect on the drilling fluid 704.

After exiting through ejection ports 152, drilling fluid 702 (and trapped gases 704) enter the space between barrel separator 106 and outer barrel 108 (i.e. in bore 180 of outer barrel 108). Since the gas-separator 100 is installed vertically, buoyant gas bubbles 704 travel towards lower surface 176 of the upper sub 102, and from there, through annulus notch cuts 143 and notch cuts 166 to fluid space 170. From fluid space 170, the separated (and buoyant) gas bubbles 704 enter release channels 128, travel up and out from gas-separator 100 at release vents 148. The treated (gas-cleansed) drilling fluid 702, being heavier, flows into delivery passages 138 and to central bore 178 of lower sub 114. From central bore 178, the treated drilling fluid 702 exits gas-separator 100 and travels to motors and pumps installed downstream in drill string 706, and from there, to the BHA and to drilling bits. So, from the space between barrel separator 106 and outer barrel 108 (i.e. in bore 180) the separated gas bubbles 704 and treated drilling fluid 702 follow different paths.

Alternatively, gas-separator 100 can be placed near or at the lowest end of the drill string if the objective is to cleanse gases prior to returning the drilling fluid to the surface, rather than to protect pumping equipment or the BHA.

As a result of efficient gas-separation, gas-separators of the invention help protect pumps and other equipment against corrosion, and also help prevent cavitation (or 'gas-locking') of pumping equipment, and accumulation of flammable gases (such as methane or natural gas). Additionally, due to efficient gas-separation, gas-separators of the invention help maintain the necessary hydrostatic pressure in the well-bore, by maintaining the requisite composition and viscosity of the recycled drilling fluid.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A gas-separator for removing gases from drilling fluid, comprising:

an upper sub with an outer wall and a first central bore, the upper sub being attachable to a first portion of a drill string above the gas-separator;

a lower sub with a second central bore, the lower sub being attachable to a second portion of the drill string below the gas-separator;

an outer barrel connecting an outer lower side of the upper sub with an outer upper side of the lower sub and defining a third central bore inside the outer barrel;

a barrel separator located within the third central bore and including a plurality of fluid ejection ports aligned to eject fluid in a direction which is substantially tangential with a cross-sectional periphery of said barrel separator such that an outflow of drilling fluid and gases from the interior of said barrel separator through the fluid ejection ports induces a rotational torque transverse to the axis of said barrel separator, which causes said barrel separator to spin on the longitudinal axis of said barrel separator;

an upper annular bearing positioned inside an annulus bearing seat at the upper end of said barrel separator, said upper annular bearing having a fourth central bore and a ridge ring and having first set of notch cuts extending from the fourth central bore and through the ridge ring so as to provide at least one fluid pathway from the interior of said barrel separator to a lower entry of at least one channel extending from a lower surface of the upper sub and to a vent on the outer surface of the outer wall.

2. The gas-separator of claim 1 wherein a delivery tube aligned with the first central bore extends from the lower side of the upper sub into the interior of the barrel separator and passes through the fourth central bore.

3. The gas-separator of claim 1 wherein said annulus bearing seat has an annulus outer wall with at least one annulus notch cut extending through said annulus outer wall, such that gases can pass from the exterior of the barrel separator, through the annulus notch cut, into the annulus bearing seat, into the first set of notch cuts and into the channel.

4. The gas-separator of claim 1 wherein the lower end of the barrel separator has a pivot stub extending downwardly and positioned inside a central aperture of a lower annular bearing supported at the upper side of the lower sub.

5. The gas-separator of claim 4 wherein, the upper annular bearing and the lower annular bearing are made of an aluminum bronze alloy.

6. The gas-separator of claim 1 wherein drilling fluid from the fluid ejection ports flows into the third central bore and then into the second central bore.

7. The gas-separator of claim 1 wherein passages connecting the third central bore with the second central bore surround the periphery of a lower annular bearing.

8. The gas-separator of claim 1 wherein, said fluid ejection ports have a narrower cross-section towards the interior of the barrel separator and a widening cross-section towards the periphery of the barrel separator.

9. The gas-separator of claim 5 wherein, aluminum bronze alloy is 85% Cu, 10.80% Al, 3.67% Fe, 0.42% Mn and 0.11% Ni.

10. A gas-separator for removing gases from drilling fluid, comprising:

an upper sub with an outer wall and a first central bore, the upper sub being attachable to portion of a drill string above the gas-separator;

a lower sub with a second central bore, the lower sub being attachable to a portion of the drill string below the gas-separator;

an outer barrel connecting an outer lower side of the upper sub with an outer upper side of the lower sub and defining a third central bore inside the outer barrel;

a barrel separator located within the third central bore and including a plurality of fluid ejection ports aligned to eject fluid in a direction which is substantially tangential with cross-sectional periphery of said barrel separator such that an outflow of drilling fluid and gases from the interior of said barrel separator through the fluid ejection ports induces a rotational torque transverse to the axis of said barrel separator, which causes said barrel separator to spin on the longitudinal axis of said barrel separator;

an upper annular bearing positioned inside an annulus bearing seat at the upper end of said barrel separator, said upper annular bearing having a fourth central bore and a ridge ring and having first set of notch cuts extending from the fourth central bore and through the ridge ring so as to provide at least one fluid pathway from the interior of said barrel separator to a lower entry of at least one channel extending from a lower surface of the upper sub and to a vent on the outer surface of the outer wall, and a lower annular bearing supported at the upper side of the lower sub, said lower annular bearing supporting a pivot stub of the barrel separator, said pivot stub extending downwardly and positioned inside a central aperture of the lower annular bearing, said upper annular bearing and said lower annular bearing are made of an aluminum bronze alloy.

11. The gas-separator of claim 10 wherein, said aluminum bronze alloy is 85% Cu, 10.80% Al, 3.67% Fe, 0.42% Mn and 0.11% Ni.

12. The gas-separator of claim 10 wherein, said annulus bearing seat has an annulus outer wall with at least one annulus notch cut extending through said annulus outer wall, such that gases can pass from the exterior of the barrel separator, through the annulus notch cut, into the annulus bearing seat, into the first set of notch cuts and into the channel.

13. The gas-separator of claim 10 wherein, a delivery tube aligned with the first central bore extends from the lower side of the upper sub into the interior of the barrel separator and passes through the fourth central bore.

14. The gas-separator of claim 10 wherein, said fluid ejection ports have a narrower cross-section towards the interior of the barrel separator and a widening cross-section towards the periphery of barrel separator.

15. The gas-separator of claim 10 wherein drilling fluid from the fluid ejection ports flows into the third central bore and then into the second central bore.

16. The gas-separator of claim 10 wherein, gases ejected from the fluid ejection ports flow through said annulus notch cut, said first set of notch cuts and said at least one channel before ejecting from the gas-separator from through said vent.

* * * * *